United States Patent [19]

Shang et al.

[11] 3,976,437

[45]*Aug. 24, 1976

[54] COMPOSITION COMPRISING A METHYL PHENOL AND AN ETHER FOR GASOLINE FUELS

[75] Inventors: Jer-Yu Shang, Pittsburgh, Pa.; Barry A. Bisson, Wilmington, Del.; Raymond Wynkoop, Gladwyne, Pa.

[73] Assignee: Sun Ventures, Inc., St. Davids, Pa.

[ * ] Notice: The portion of the term of this patent subsequent to Sept. 17, 1991, has been disclaimed.

[22] Filed: Sept. 13, 1974

[21] Appl. No.: 505,820

Related U.S. Application Data

[63] Continuation-in-part of Ser. No. 265,850, June 23, 1972, Pat. No. 3,836,342, and a continuation-in-part of Ser. No. 440,619, Feb. 7, 1974, abandoned.

[52] U.S. Cl. ..... 44/56; 44/69; 252/386

[51] Int. Cl.[2] ..... C10L 1/18

[58] Field of Search ..... 44/56, 69, 51, 77, 78; 252/386

[56] References Cited

UNITED STATES PATENTS

| | | | |
|---|---|---|---|
| 2,240,040 | 4/1941 | Hooten | 44/56 |
| 2,434,650 | 1/1948 | Herbst | 44/78 |
| 2,952,612 | 9/1960 | Trainer | 44/56 |
| 3,030,195 | 4/1962 | Ewan | 44/56 |
| 3,082,070 | 3/1963 | Eckert | 44/70 |
| 3,224,848 | 12/1965 | Henderson | 44/56 |

OTHER PUBLICATIONS

Unzelman et al., "Are There Substitutes for Lead Antiknocks," May 14, 1971, p. 888, API, Div. of Refg. Proceedings.

*Primary Examiner*—Daniel E. Wyman
*Assistant Examiner*—Y. Harris-Smith
*Attorney, Agent, or Firm*—J. Edward Hess; Donald R. Johnson; Stanford M. Back

[57] ABSTRACT

A useful additive for gasoline is a mixture of a methyl-substituted phenol and an ether containing a branched alkyl group and boiling below 460°F. Preferably, the phenol and ether are present in amounts and in relative proportions sufficient to provide a synergistic increase in the research octane number of a gasoline. A preferred composition contains one part by volume of para-cresol to from 0.1 to 10 parts of methyl methoxy propane. The composition can also contain an aliphatic alcohol, an octane boosting cerium compound and conventional gasoline additives.

10 Claims, 2 Drawing Figures

FIG. I

COMPOSITION COMPRISING A METHYL PHENOL AND AN ETHER FOR GASOLINE FUELS

BACKGROUND OF THE INVENTION

Figure 1:
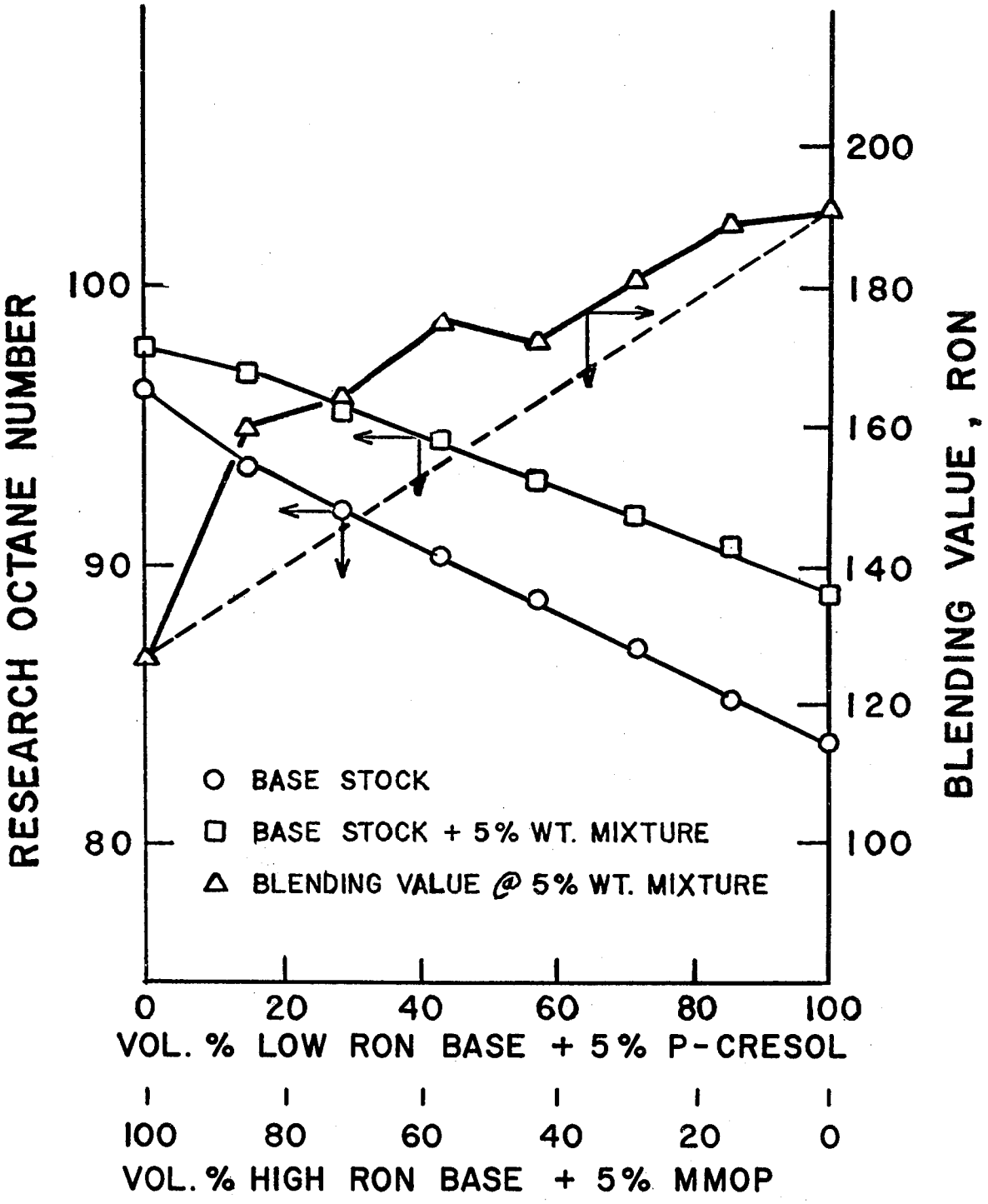

This application is a continuation-in-part of our applications Ser. No. 265,850 filed June 23, 1972 (now U.S. Pat. No. 3,836,342 issued Sept. 17, 1974) and Ser. No. 440,614 filed Feb. 7, 1974 now abandoned, the entire disclosure of said applications being incorporated herein by reference.

SUMMARY OF THE INVENTION

A useful additive for gasoline is a mixture of a methyl-substituted phenol and an ether containing a branched alkyl group and boiling below 460°F. Preferably, the phenol and ether are present in amounts and in relative proportions sufficient to provide a synergistic increase in the research octane number of a gasoline. A preferred composition contains one part by volume of para-cresol to from 0.1 to 10 parts of methyl methoxy propane. The composition can also contain an aliphatic alcohol, an octane boosting cerium compound and conventional gasoline additives.

The composition is useful in making a gasoline comprising a hydrocarbon base stock of gasoline boiling range, a methyl-substituted phenol and an ether having at least one branched alkyl group and boiling below 460°F, said phenol and said ether each being present in amount sufficient to increase the research octane number (see U.S. Pat. No. 3,836,342).

The preferred methyl-substituted phenols include the cresols (e.g., para-cresol), the xylenols (e.g., hydroxy pseudocumene, hydroxy mesitylene, and hemimellitol) and mixtures of such phenols, with the greater proportion of cresols being preferred where the composition is to be added to a low RON gasoline (including "leaded" or "unleaded" gasolines.

The preferred ethers comprise the dialkyl ethers wherein at least one alkyl group is branched, and include diisopropyl ether, diisobutyl ether, methyl isopentyl ether, methyl isopropyl ether, and mixtures of two or more said ethers. Phenyl alkyl ethers can also be used (e.g., isopropyl phenyl ether). One non-branched alkyl phenyl ether which can be used in admixture with a methyl phenol, especially para-cresol, is methyl phenyl ether (in relative proportions, by volume of 1 to 20 to 20 to 1, more preferred 1 to 10 to 10 to 1. The ethers and phenols which can be used in our invention include those described by G. H. Unzdman, E. J. Forster and A. M. Burns, in API Preprint (Division of Refining) No. 47 to 71, titled "Are There Substitutes for Lead Antiknocks?", presented at the API meeting in San Francisco, May 14, 1971.

Generally, the amount of the ether in the final gasoline can be in the range of 0.05 to 30 percent and the amount of the phenol in the range of 0.05 to 35 percent (the limit being determined by solubility); however, the preferred amounts are in the range of 0.1 to 15 percent. More preferred, the phenol is in the range of 0.5 to 10 weight percent and the total of said amounts is in the range of 1 to 15 weight percent. Accordingly, the relative proportions in the additive composition are chosen to provide octane improvement in gasoline when added thereto in these concentrations.

FURTHER DESCRIPTION OF THE INVENTION

Figure 2:
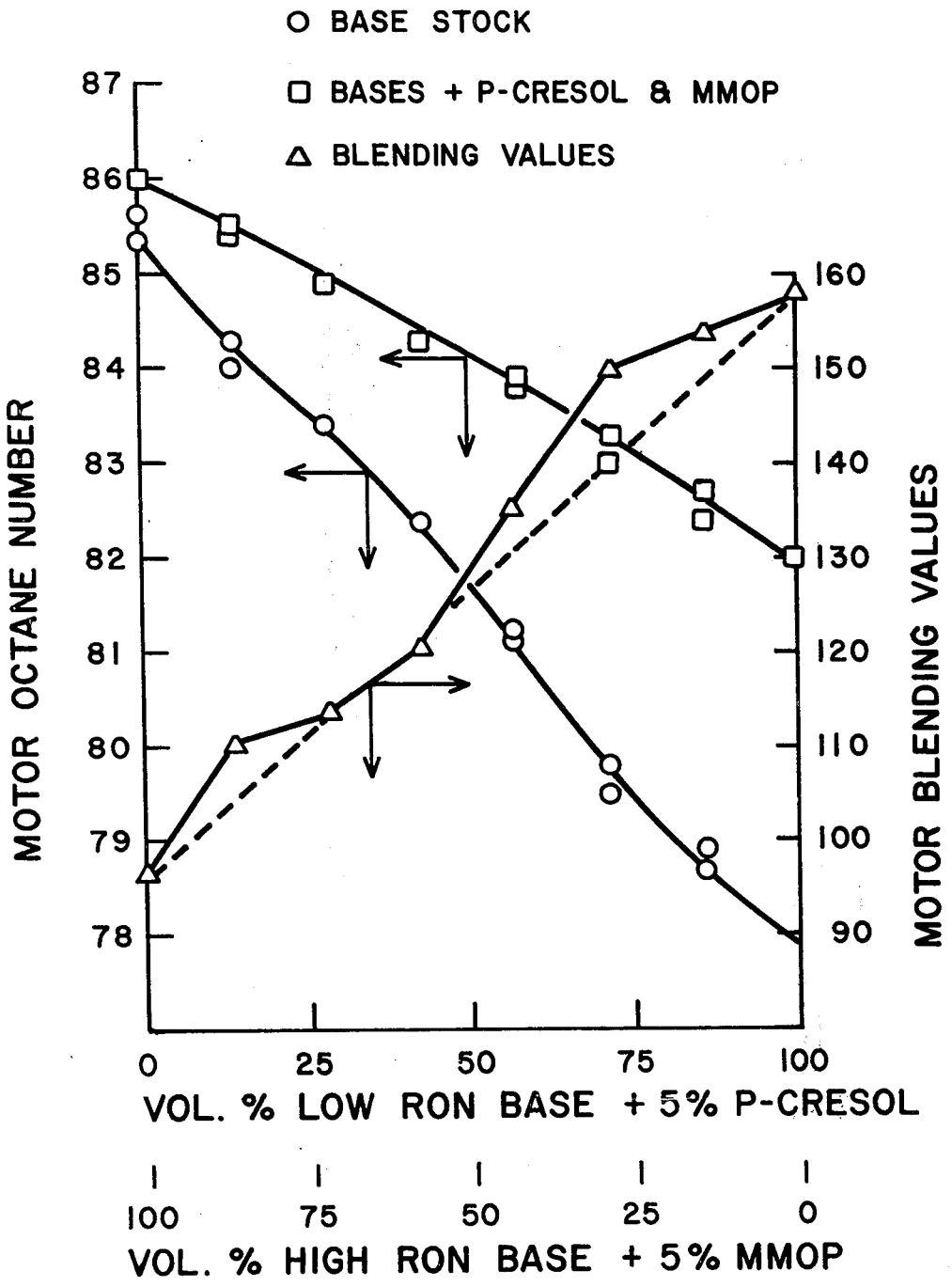

The accompanying FIGS. 1 and 2 in our parent applications illustrate the beneficial synergistic effect on research octane blending and motor octane blending values which can be obtained when a mixture of paracresol and methyl methoxy propane is added to blends of low RON and high RON gasolines. These showings indicate that such a mixture can be useful for decreasing the "knocking" tendency of gasolines commonly marketed as "regular", "premium" and "unleaded". Accordingly, the mixtures of the present invention can be used to permit the use of "regular" and "unleaded" gasolines in engines which would normally require "premium" or to permit the use of "premium" in engines which normally require "super premium". The relative proportions and amounts of the cresol and phenol which are required in a given final gasoline will depend upon the given hydrocarbon gasoline components and additives in the gasoline. Usually, a low RON gasoline should contain a greater proportion of a cresol (or mixture of cresols), typically, 1 to 15 weight percent, usually preferred 2 to 10 weight percent, e.g., four percent para-cresol, one percent MMOP. A high RON gasoline should contain a greater proportion of the ether, typically 1 to 20 weight percent, more preferred 2 to 15 weight percent (e.g., 5 percent MMOP (methyl methoxy propane) or methyl tertiary butyl ether and 1 percent para-cresol.

The mixtures can also contain other additives such as a lead antiknock (e.g., 0.1 to 4 cc TEL per gallon), a lead scavenger (e.g., organo bromides, ethylene dichloride), deposit modifiers (e.g., boron and phosphorus compounds), lower acyclic alcohols (e.g., methanol, ethanol, isopropanol, butanol, etc.), a lead appreciator (e.g., t-butylacetate), oxidation inhibitors (e.g., aromatic amines and/or alkyl phenols, such as 2,6-di-t-butyl-p-cresol), metal deactivators (e.g., NN'-disalicylidene-1,2-propylene diamine), corrosion inhibitors (e.g., high molecular weight phosphoric, carboxylic or sulfonic acids or their reaction products with nitrogen bases, such as amines, and include "Ethyl MPA"), antistatic additives (e.g., "Shell ASA-3") and anti-icing additives (e.g., methylcellosolve and glycerol). Some of these gasoline additives are described, for example, by J. P. Heuston, "Chemical Additives in Petroleum Fuels", *S. African Ind. Chemist*, 20:65–70, 74 (1966).

The gasoline can also contain a "cerium" type antiknock additive.

An especially useful component in addition to the ether and the phenol is an acyclic alcohol containing in the range of one to four carbon atoms, the relative proportion, based on the volume of the ether, being in the range of 1 to 15 to 15 to 1. Such alcohols increase the RON of the gasolines and also can cause water (which may be present in the gasoline) to act as an octane improving additive.

Among the cresols, the ortho and meta isomers are less preferred in gasoline than para-cresol. That is, paracresol has higher research and motor octane blending values (and lower sensitivity) than the other isomers. Each of these isomers can absorb (or dissolve) in the order of two weight percent water and, with about 15 weight percent cresols in gasoline the water solubility is about 0.5 weight percent. If this amount of water is added to the gasoline, it reduces flame temperature, and thus, the NOx (nitrogen oxides) emission and increases the power output of the engine.

Similarly, a water, a $C_4$ alcohol and an ether can be added to gasoline to attain greater antiknock reduction than with the alcohol and ether alone. On a lead-free basis, the higher proportions ether to phenol will typically be used in mixtures which are to be added to gasoline having an RON in the range of 90 to 105. However, where the gasoline contains a lead antiknock compound (such as mixed methyl and ethyl leads, e.g., dimethyl diethyl lead, etc.), mixtures with the higher proportions of a phenol could be useful as additives to gasoline in the range of 65 to 95 RON, typically 75 to 90 RON. Of course, the relative proportions of phenol to ether (and of alcohol, if present) will be determined to a great extent by the relative costs of each component as octane improving additives (e.g., cents per Δ RON). Typically, the hydrocarbon base of a high RON gasoline contains in the range of 20 to 40 percent aromatics, 0 to 20 percent olefins, 0 to 10 percent naphthenes, with the balance being paraffins (the minimum paraffin content being 45 percent, more preferred 55 percent). A low RON gasoline can contain in the range of 15 to 40 percent aromatics, 0 to 25 percent olefins, 2 to 20 percent naphthenes, with the balance being paraffins, the minimum paraffin content being 35 percent (more preferred 45 percent). Many commercial gasolines will have compositions which can be represented by blends of such high and low RON bases. Mixtures of an ether and a phenol are especially useful in increasing the RON of a gasoline where the hydrocarbon base stock contains in the range of 40 to 75 percent paraffins, 0 to 10 percent naphthenes, 0 to 20 percent olefins and 20 to 40 percent aromatics. Especially good results are obtained where the base stock has an RON in the range of 80 to 100, and an MON in the range of 75 to 95. For the synergistic effect disclosed herein with para-cresol and MMOP, an especially useful base stock contains in the range of 50 to 60 percent paraffins, 1 to 10 percent naphthenes, 2 to 10 percent olefins and 28 to 38 percent aromatics.

Gasoline shortages can force the motorist to buy regular gasoline because a station is out of premium gasoline.

In general, the quantity of mixture to be added is chosen to provide about 2.5 weight percent total phenol and ether in a gasoline, a level which can provide an R+M/2 increase of about two to four octane numbers when added to leaded (two to three grams per gallon) regular gasoline or to the new no lead gasoline. The difference in octane between premium and regular is about five; however, in most cases a two or three increase is sufficient to significantly reduce knocking.

The mixture of mesityloxide, 4-methylpent-4-ene-2-one and 2,4-dimethyl furan of U.S. Pat. No. 3,782,911 can be present in the mixture of the present invention (e.g., 5 to 70 volume percent). A phenol-ether mixture can also contain aniline, aromatic hydrocarbons (mesitylene) and other oxygen compounds, such as mesityloxide, acetic acid, t-butanol, methanol, isopropanol, polyhydroxynaphthalenes, polyhydroxybenzenes, etc., the limiting factors being toxicity, odor, cost, solubility and volatility. The product can also contain conventional gasoline additives (TCP, etc.).

ILLUSTRATIVE EXAMPLE

A typical "regular" gasoline is obtained by blending selected refinery streams, including catalytically cracked gasoline, straight run gasoline, reformate, "aviation" alkylate, butane, etc. With the addition of lead tetraethyl (two grams lead per gallon), the resulting gasoline has a motor octane number of 87 and a research octane number of 94.5. When used as a fuel in a 1968 Oldsmobile F-85 station wagon with a V-8 engine, severe knocking is observed upon acceleration or when going up hills.

Two quarts of a mixture of five volumes methyl methoxy propane and six volumes para-cresol are added to the gas tank of the Oldsmobile, which contains 18 gallons of the regular gasoline. The knocking on acceleration and on going uphill is greatly reduced.

Similarly, a great reduction in such knocking in the Oldsmobile is also obtained when two quarts of a mixture containing 15 volume percent t-butyl alcohol, 60 percent MMOP and 25 percent para-cresol is added to 18 gallons of the regular gasoline in the tank.

A commercial "No Lead" gasoline is obtained by blending about 10 volume percent alkylate, 15 percent reformate, 5 percent butane and 70 percent of a mixture of catalytic and straight run gasolines, to attain an MON of 83 and RON of 92. Severe knocking is observed on acceleration and on going uphill.

Two quarts of a mixture of seven volumes MMOP and three volumes para-cresol are added to 18 gallons of this gasoline. On this fuel the knocking is greatly reduced both on acceleration and on going uphill.

It can be seen from the foregoing that the present invention can provide a practical solution to the problem of shortages of high octane premium or super premium fuel, when "regular" or "economy" or "no lead" are available.

The invention claimed is:

1. Composition, useful for increasing the research octane number of gasoline, comprising a mixture of a methyl-substituted phenol and a hydrocarbyl ether having at least one branched alkyl group and boiling below 460°F, said phenol and said. ether each being present in amount sufficient to increase the research octane number of a hydrocarbon gasoline base stock having a research octane number in the range of 85 to 95.

2. Composition according to claim 1 and wherein the amounts of said mixture of said phenol and said ether are in the range of 15 to 100 volume percent.

3. Composition according to claim 1 and wherein the relative proportion of said phenol to said ether is in the range of 1 to 20 to 20 to 1.

4. Composition according to claim 1 and wherein said ether is methyl methoxypropane.

5. Composition according to claim 1 and wherein said phenol is selected from the group consisting of ortho, meta and para-cresol and mixtures of two or more said cresols.

6. Composition according to claim 5 and wherein said ether is methyl methoxypropane.

7. Composition according to claim 6 and wherein said phenol consists essentially of para-cresol.

8. Composition according to claim 6 and wherein the amount of said phenol is in the range of 5 to 95 percent, said amount of said ether is in the range of 5 to 95 percent and the total of said amounts is in the range of 10 to 100 percent.

9. Composition according to claim 1 and containing as an additional component an acyclic alcohol having one to four carbon atoms.

10. Composition according to claim 9 wherein said alcohol is monohydroxy and is present in volume proportion of 1 to 15 to 15 to 1 based on said ether.

* * * * *